US009193027B2

(12) United States Patent
Loebmann et al.

(10) Patent No.: US 9,193,027 B2
(45) Date of Patent: Nov. 24, 2015

(54) RETAINER RING

(75) Inventors: André Loebmann, Laussnitz (DE); Norman Nagel, Dresden (DE)

(73) Assignee: INFINEON TECHNOLOGIES AG, Neubiberg (DE)

( * ) Notice: Subject to any disclaimer, the term of this patent is extended or adjusted under 35 U.S.C. 154(b) by 429 days.

(21) Appl. No.: 13/479,295

(22) Filed: May 24, 2012

(65) Prior Publication Data

US 2013/0316620 A1 Nov. 28, 2013

(51) Int. Cl.

| | |
|---|---|
| ***B24B 37/10*** | (2012.01) |
| ***B24B 37/04*** | (2012.01) |
| ***B24B 7/22*** | (2006.01) |
| ***B24B 37/27*** | (2012.01) |
| ***B24B 37/32*** | (2012.01) |

(52) U.S. Cl.

CPC ..... *B24B 37/10* (2013.01); *B24B 7/228* (2013.01); *B24B 37/042* (2013.01); *B24B 37/27* (2013.01); *B24B 37/32* (2013.01)

(58) Field of Classification Search

CPC ..... B24B 37/32; B24B 7/228; B24B 37/10; B24B 37/042

USPC ..... 451/41, 59, 63, 286, 287, 288, 289, 451/290, 398

See application file for complete search history.

(56) References Cited

U.S. PATENT DOCUMENTS

| | | | | |
|---|---|---|---|---|
| 5,906,532 | A * | 5/1999 | Nakajima et al. | 451/41 |
| 6,001,007 | A * | 12/1999 | Maeda et al. | 451/398 |
| 6,110,025 | A * | 8/2000 | Williams et al. | 451/286 |
| 6,116,992 | A * | 9/2000 | Prince | 451/286 |
| 6,224,472 | B1 * | 5/2001 | Lai et al. | 451/398 |
| 6,354,927 | B1 * | 3/2002 | Natalicio | 451/287 |
| 6,447,380 | B1 * | 9/2002 | Pham et al. | 451/288 |
| 7,044,838 | B2 * | 5/2006 | Maloney et al. | 451/41 |
| 7,344,434 | B2 * | 3/2008 | Chen et al. | 451/285 |
| 8,033,895 | B2 * | 10/2011 | Prabhu et al. | 451/286 |
| 2008/0160885 | A1 * | 7/2008 | Winterlich et al. | 451/286 |
| 2010/0112914 | A1 * | 5/2010 | Marohl et al. | 451/364 |

FOREIGN PATENT DOCUMENTS

| | | | |
|---|---|---|---|
| CN | 1910012 | A | 2/2007 |
| CN | 101778697 | A | 7/2010 |
| WO | 2005049274 | A2 | 6/2005 |
| WO | 2009012444 | A1 | 1/2009 |

* cited by examiner

*Primary Examiner* — Timothy V Eley

(57) ABSTRACT

A retainer ring is provided for use in conjunction with Chemical Mechanical Polishing apparatus which polishing is used to polish a substrate. Particularly, the retainer ring includes an inner surface defining a retainer area, an outer surface, a front surface extending between the inner and outer surface, the front surface being in contact with the polishing pad during polishing and a transition region between the outer surface and the front surface. A CMP apparatus which includes at least a ring having the above features is also provided for.

25 Claims, 11 Drawing Sheets

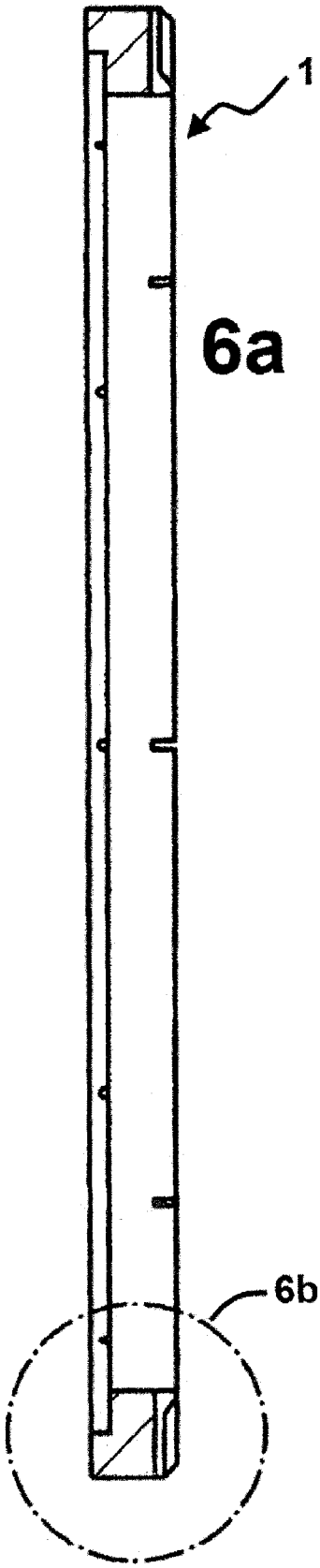
FIG. 6
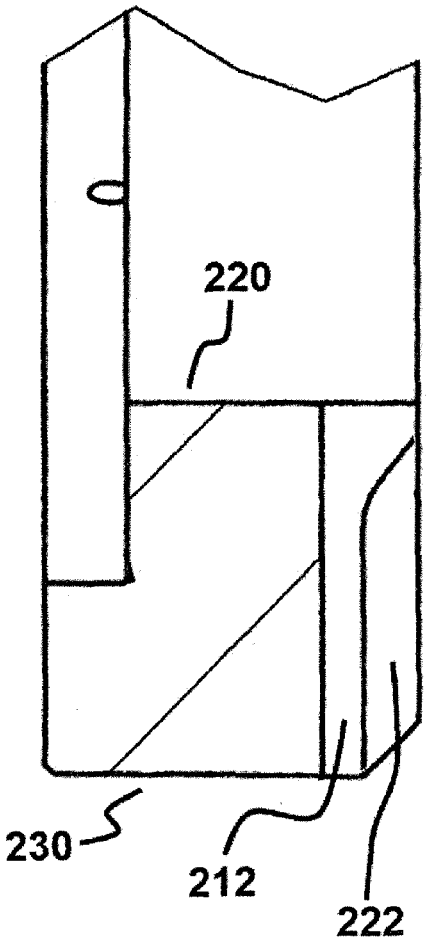
6b

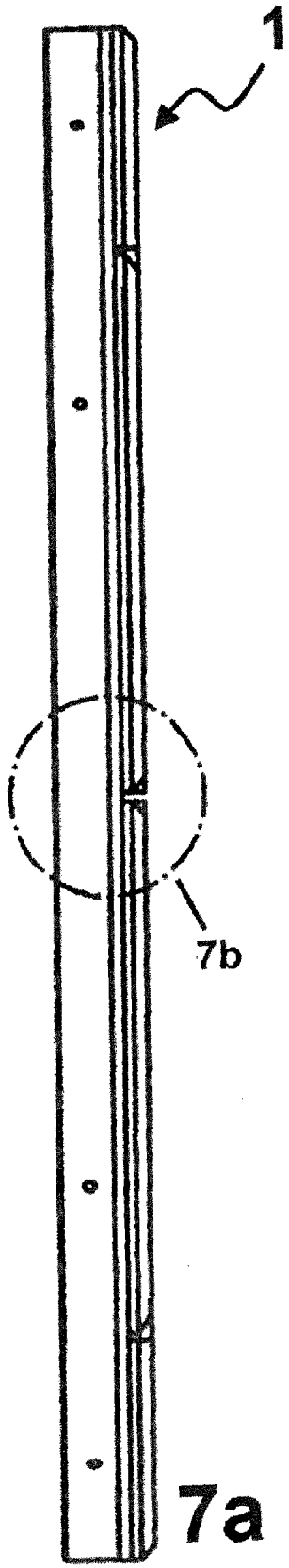
FIG. 7
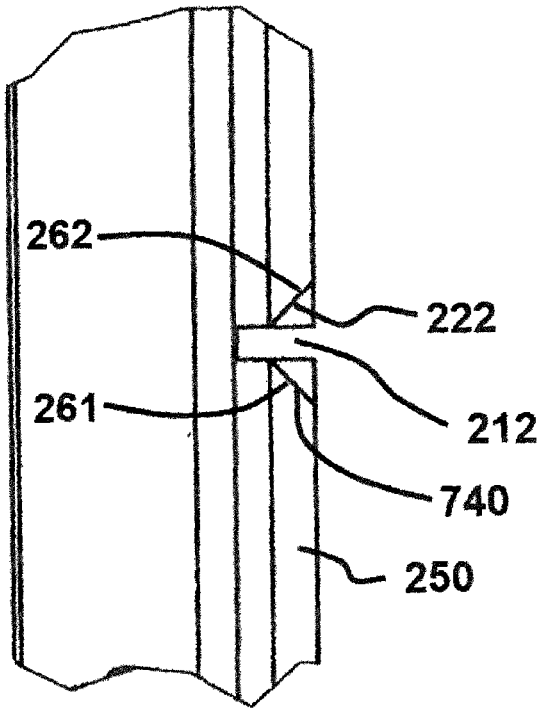
7b

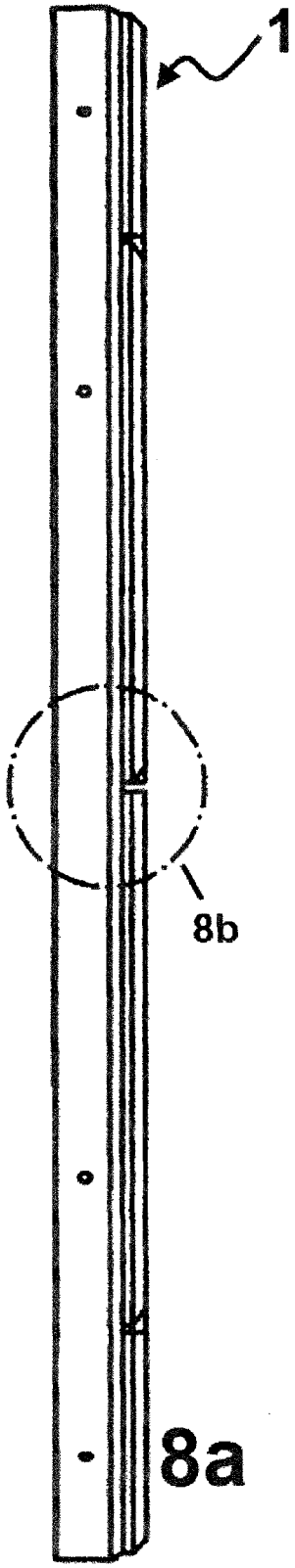
FIG. 8
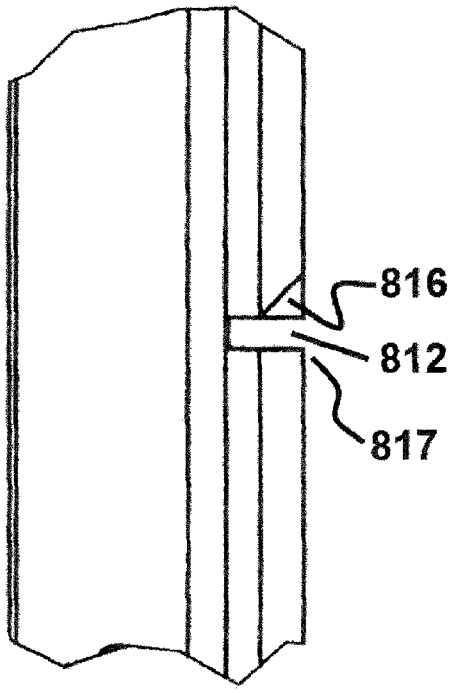
8b

RETAINER RING

TECHNICAL FIELD

Various aspects of this disclosure relate generally to chemical mechanical polishing/planarization. More particularly, this disclosure relates to a retainer ring that may be used in chemical mechanical polishing.

BACKGROUND

Typically, an integrated circuit includes electronic components, such as transistors, capacitors, or the like, integrated into a thin wafer/substrate of semiconductor material, e.g. silicon. Additional materials are deposited and patterned to form interconnections between the electronic components.

During the fabrication process, it may be necessary or desirable to perform one or more planarization processes on the wafer/substrate in order to achieve an atomically-smooth and damage-free surface at feature level. A commonly accepted process to achieve the flat surface involves Chemical Mechanical Polishing/Planarization (CMP). CMP is a process for material removal that uses chemical and mechanical mechanisms to produce a planar mirror-like wafer surface for subsequent processing. This process typically requires that the wafer/substrate be mounted on a carrier or polishing head of a CMP apparatus. The exposed surface of the substrate is placed against a rotating polishing disk pad or belt pad covered at least partially by slurry. A polishing slurry, including at least one chemically-reactive agent and abrasive particles if a standard pad is used, is supplied to the surface of the polishing pad. Both continual slurry movement and constant abrasion by the disk pad of the apparatus lead to a polished wafer surface. The carrier head provides a nominally uniform controllable load on the wafer/substrate to push it against the polishing pad. The carrier head has a retainer ring which holds the substrate in place during polishing.

SUMMARY OF THE INVENTION

A retainer ring is provided for use in conjunction with Chemical Mechanical Polishing apparatus which polishing is used to polish a substrate. Particularly, the retainer ring includes an inner surface defining a retainer area, an outer surface, a front surface extending between the inner and outer surface, the front surface being in contact with the polishing pad during polishing and a transition region between the outer surface and the front surface. A CMP apparatus which includes at least a ring having the above features is also provided for.

In another aspect of the disclosure, the transition region has a conical profile. This conical profile can reduce wear to the ring over its lifetime. In another aspect of the disclosure, the transition region has a taper of 45 degrees. The transition region can also have different shapes, for example, concave or convex. In other aspects of the disclosure, the region can be maximized to reduce wear on a polishing pad used to polish the substrate.

Furthermore, the ring may include channels extending at least partially from the inner surface to the outer surface. In an aspect of the disclosure, at least one wall of the channel includes a second transition region at least partially along its lengths. The transition region and the second transition region can come together to form a mitered edge. Moreover, the transition region may extend to a depth exceeding the expected service wear depth of the retainer ring. Alternatively, the transition region may not intersect the service depth of said retainer ring. The transition region is not limited to running the entire circumference of the retainer ring. It can, for example, be limited to the leading edge of the ring.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the subject matter disclosed herein. In the following description, various aspects of this disclosure are described with reference to the following drawings, in which:

FIGS. 6*a* and 6*b* show a cross-section view of an aspect of retainer ring 1 and an inset of that cross section respectively;

FIGS. 7*a* and 7*b* show a side orthographic view of an aspect of retainer ring 1 and an inset of that aspect respectively;

FIGS. 8*a* and 8*b* show an orthographic view of an aspect of retainer ring 1 an inset of that aspect respectively;

DESCRIPTION

The following detailed description refers to the accompanying drawings that show, by way of illustration, specific details and aspects of this disclosure in which the subject matter disclosed herein may be practiced.

The word "exemplary" is used herein to mean "serving as an example, instance, or illustration." Any aspect of this disclosure or design described herein as "exemplary" is not necessarily to be construed as preferred or advantageous over other aspects of this disclosure or designs.

Figure 1:
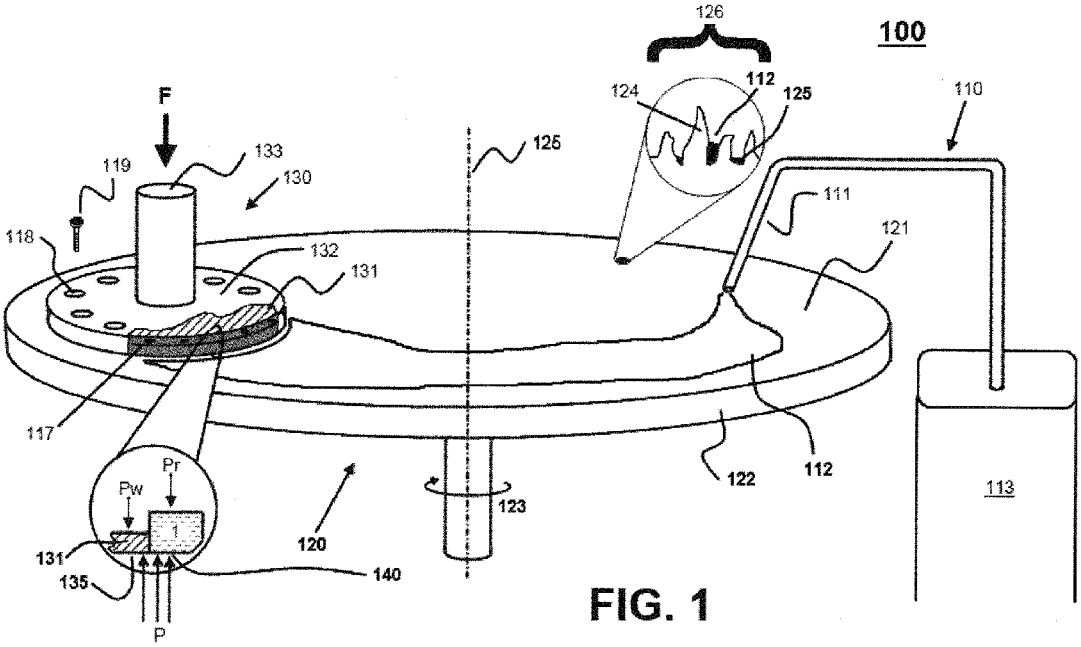
FIG. 1 shows a Chemical Mechanical Planarization/Polishing (CMP) apparatus.

Chemical Mechanical Planarization/Polishing (CMP) apparatus 100 having a retainer ring 1 in accordance with the present subject matter is shown in schematic form in FIG. 1. Slurry applicator assembly 110 includes dispensing aperture 111 for dispensing slurry 112 from slurry source 113. Polishing assembly 120 includes polishing pad 121 fixed onto platen/polishing table 122 such as by adhesive. Platen 122 is fixed onto shaft 123 rotatable about axis 125.

Wafer assembly 130, includes wafer carrier/chuck 132 surrounding wafer 131. Also included in the wafer assembly is retainer ring 1, which is fixed to wafer carrier 132 by machine screws 119 which pass through chuck bores 118 and engage threaded ring bores 117. Shaft 133, shown attached to wafer assembly 130, is typically axially rotatable, and/or movable radially relative to platen 122. Wafer 131 is shown encircled by retainer ring 1, the ring acting to provide at least lateral support for the wafer, thereby keeping the wafer centered beneath wafer assembly 130.

Slurry applicator assembly 110 is provided having a dispensing aperture 111 to dispense slurry onto pad 121. Alternatively, slurry may be provided from apertures within wafer assembly 130. An expanded view of pad 121 shows the surface of the pad. Asperities 124 in the surface characterize the 'nap' 126 of the pad, defining its roughness, as well as its ability to sequester slurry 112 typically containing nano-sized particles and/or chemically reactive agents within the recesses or pores 125 within nap 126. The nature of pad 121 in terms of its roughness may depend on factors including the material used to form the nap 126, and may vary widely according to the manufacturing processes employed in fabricating the pad 121. However pore sizes of 20-50 micrometers are typical.

During operation, platen 122 is rotated, for example clockwise, allowing slurry 112 to be distributed across the surface of pad 121, whereupon force F is applied to wafer assembly 130, bringing it into contact with pad 121 and slurry 112. Rotation of wafer assembly 130 via shaft 133 and/or radial reciprocation/oscillation thereof provides an orbital pattern of contact of wafer 131 on pad 121, while pressure $P_r$ on retainer ring 1 prevents slip-out of wafer 131.

In particular, force F, applied axially to shaft 133 biases wafer assembly 130 against platen 122, defining a pressure P at the portion of pad 121 positioned at any given time under wafer assembly 130, pressure P being a force applied per unit area. As shown in an expanded view of wafer assembly 130, force F is divided between at least front surface 140 of ring land surface 135 of wafer 131. The fraction of force F applied to ring 1 results in pressure ($P_r$) and the fraction of force F applied to wafer 131 results in pressure ($P_w$).

Whereas pressure $P_w$ applied to the surface of polishing pad 121 by wafer 131 during operation facilitates desired polishing of the wafer, the application of pressure $P_r$ between ring 1 and polishing pad 121 is not desirable in itself, except in so far as it is necessary for retention of wafer 131 during operation, as explained in further detail below.

Friction between asperities 124 in the surface of polishing pad 121 and corresponding contacting points on wafer 131 in the presence of entrained slurry 112 results in progressive ablation of the wafer surface, smoothing the wafer and/or removing layers of material from it. The rotation and oscillation of polishing pad 121 acts to transport fresh slurry to the wafer, and to carry off waste, including wafer material that has been polished away.

By providing appropriate supply of slurry, and carefully controlling the pressure on and movement of the wafer relative to the pad, the CMP process can be carried out until the desired results are achieved on the wafer, at which time the wafer may be removed from the wafer assembly, and the process continued on another wafer installed therein.

This process cannot be carried out indefinitely, however. Interaction between wafer assembly 130 and pad 121 causes wear to the pad over time, with the result that the characteristics of the nap 126 are permanently altered by repeated intermittent application of pressure P to the nap 126. Pad 121 may then polish less effectively, or may be more prone to damage a wafer during polishing. While calibration of force F to reduce pressure P may increase the service life of polishing pad 121, inadequate $P_w$ results in sub-optimal polishing results and reduction in $P_r$ risks wafer slip-out during operation. By contrast, although an increase in $P_r$ relative to $P_w$ can reduce the likelihood of wafer slip-out, an increase in $P_r$ also causes increased wear of pad and ring surfaces without any corresponding benefit in terms of polishing at the wafer. In essence, $P_r$ is associated with the superfluous action of pad 121 on ring 1. Therefore, as the wear caused at ring 1 is associated with, but does not directly result in CMP at wafer 131, losses at ring 1 and pad 121 are a form of 'production overhead' resulting in shorter service life of ring 1 and pad 121. Accordingly, calibration in the form of lowering $P_r$ relative to $P_w$ in an effort to reduce production overhead due to $P_r$ must be balanced against the risks posed by wafer slip-out, for example in terms of the respective costs of each outcome.

More particularly, interaction between retainer ring 1 and pad 121 results in distortion of pad asperities 124 due to compressive stress and/or friction that causes wear against the surface of retainer ring 1. Yet more particularly, the region of retainer ring 1 defining its outer circumference characterizes the area over which transition of the nap 126 of pad 121 from a normal to a compressed or stressed state during operation takes place. Said outer circumference therefore defines a transition region, the characteristics of which are relevant to wear of pad 121.

The ability of retainer ring 1 to prevent slip-out of wafer 131 is also compromised by wear of the ring itself through friction with the pad over time. Although replacement of pads and rings is possible, lost economic profits due to downtime, unit replacement costs, and labor costs including those associated with re-qualifying polishing pads (e.g. testing for foreign particles) could be minimized by extending the service life of the polishing pad and/or the retainer ring of a CMP device.

Figure 2A:
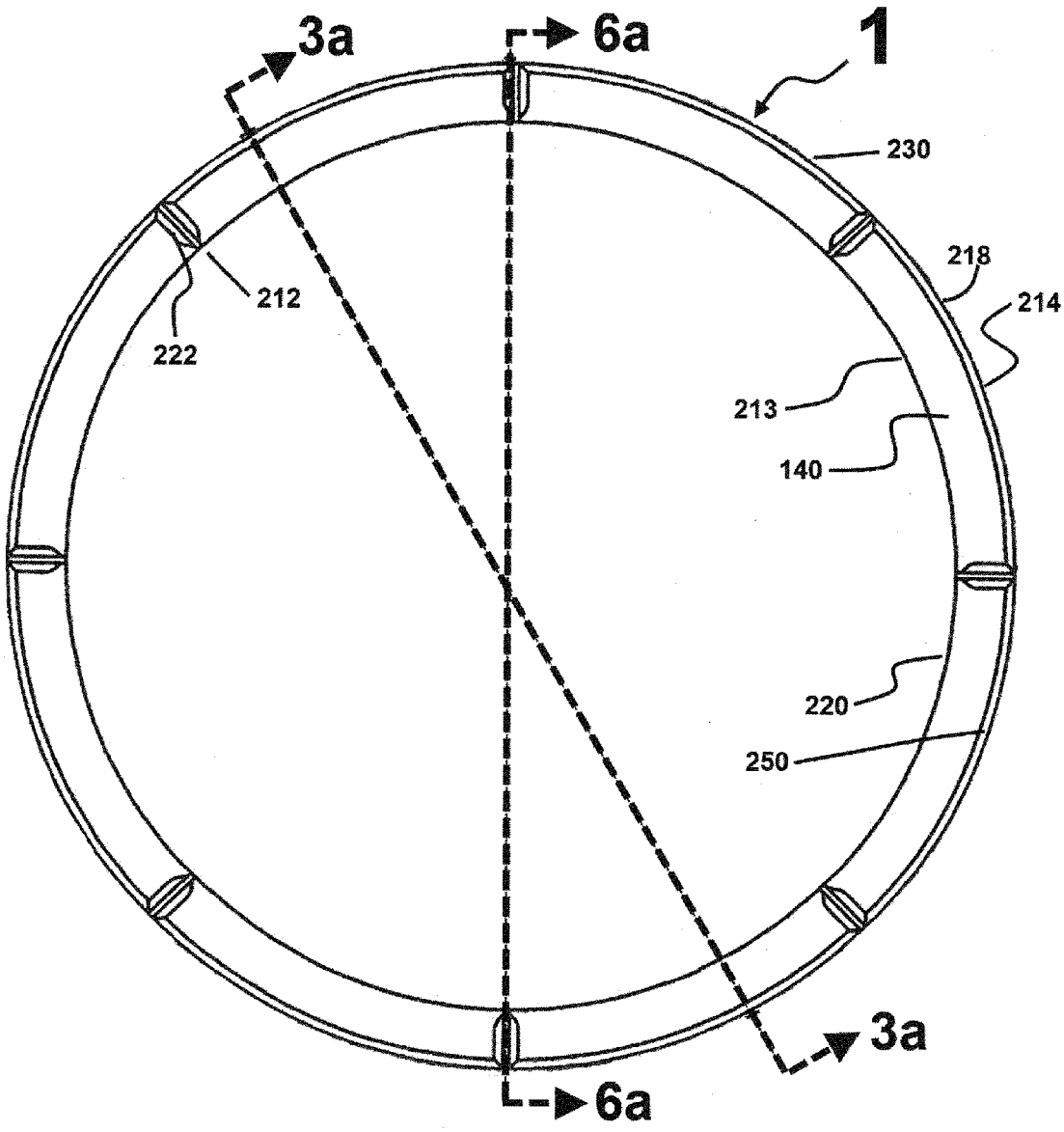
FIGS. 2*a* and 2*b* show front and rear views respectively of retainer ring 1.
Figure 2B:
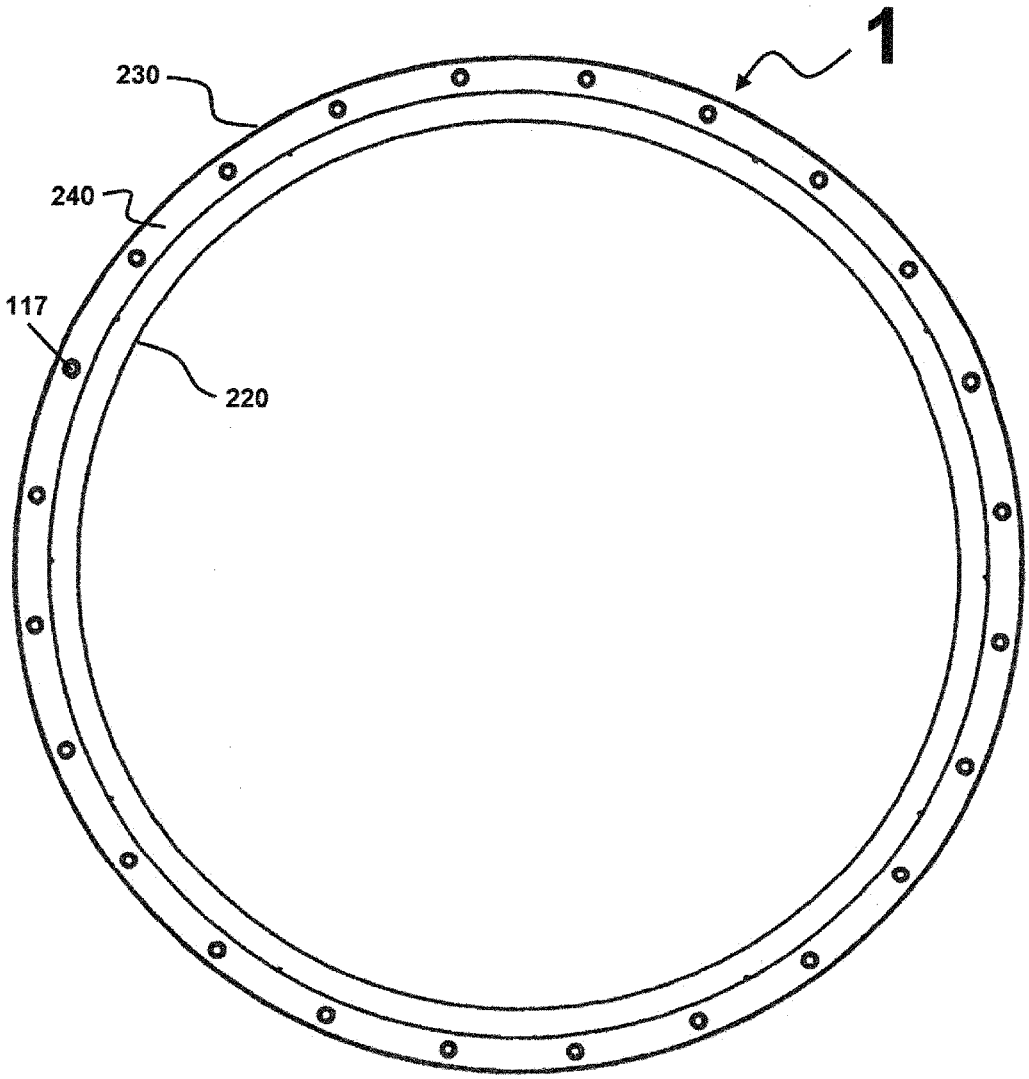

Corresponding top and bottom orthographic views of retainer ring 1 in accordance with the present disclosure are shown in FIGS. 2*a* and 2*b*, respectively. Retainer ring 1 is defined by two concentric cylindrical surfaces defining an inner surface 220 and an outer surface 230, respectively, an orthogonal annular front surface 140 extending from inner surface 220 toward outer surface 230. Back surface 240 is also shown. As retainer rings for use in CMP such as the retainer ring shown in FIGS. 2*a* and 2*b* are generally configured for use with wafers of a particular size, the diameter of inner surface 220 is typically matched to that of the wafers to be polished. For example a diameter of about 201 mm to is configured to receive a 200 mm wafer. The diameter of outer surface 230 defines, in part, the width of annular front surface 140, and may typically exceed the inner diameter by about 30 mm. Threaded bores 117 located in back surface 240 extend part way into back surface 240 towards front surface 140.

Inner surface 220 and front surface 140 of retainer ring 1 are shown intersecting at inner edge 213, which typically forms at a relatively sharp corner for example at a right angle. By contrast, outer edge 214 of retainer ring 1 is shown having a tapered profile, the taper extending radially along transition region 250 between the outer edge of front surface 140 and outer surface 230. Transition region 250 is shown extending along the entire circumference of front surface 140.

In this case the inner surface defines a retainer area that functions to retain the wafer in place during chemical mechanical polishing. As shown in FIGS. 2*a* and 2*b*, the inner surface is defined by a cylindrical surface defining the inner diameter of the ring, the inner diameter corresponding to the size of the silicon wafer being retained. In this case, a circular silicon wafer would be indicated. However, wafers of other shapes could be accommodated by retaining rings having a different inner surface shape for retaining wafers having a non-circular shape. For example, an inner surface defining a square retainer area would be appropriate for example for a non-circular wafer, more particularly a square wafer.

FIGS. 3*a* and 3*b* show a cross section of retainer ring 1. In this view, tapered transition region 250 is more clearly shown as well as inner edge 213 and outer edge 214. The taper, as illustrated in FIG. 3*a* (and likewise in the inset FIG. 3*b*), may extend linearly at a 45° angle from outer surface 230 to front surface 140. The radial dimension of transition region in this configuration is therefore defined by the depth 318 of the taper measured at outer surface 230. For example, at a taper depth 318 of 2 mm, transition region 250 extends for a taper length 319 of 2 mm radially inward from outer surface 230.

In use, retainer ring 1 is affixed at threaded bores 117 to wafer assembly 130 by machine screws 119, exposing front surface 140 to pad 121 as shown in FIG. 1. During CMP, force F is applied, pressing wafer assembly 130 against pad 121 with the result that a pressure $P_r$ develops between front surface 140 and pad 121. Wafer 131, which may be concurrently pressed against pad 121, is contained within the cylindrical volume defined by inner surface 220 of retainer ring 1.

Figure 3:
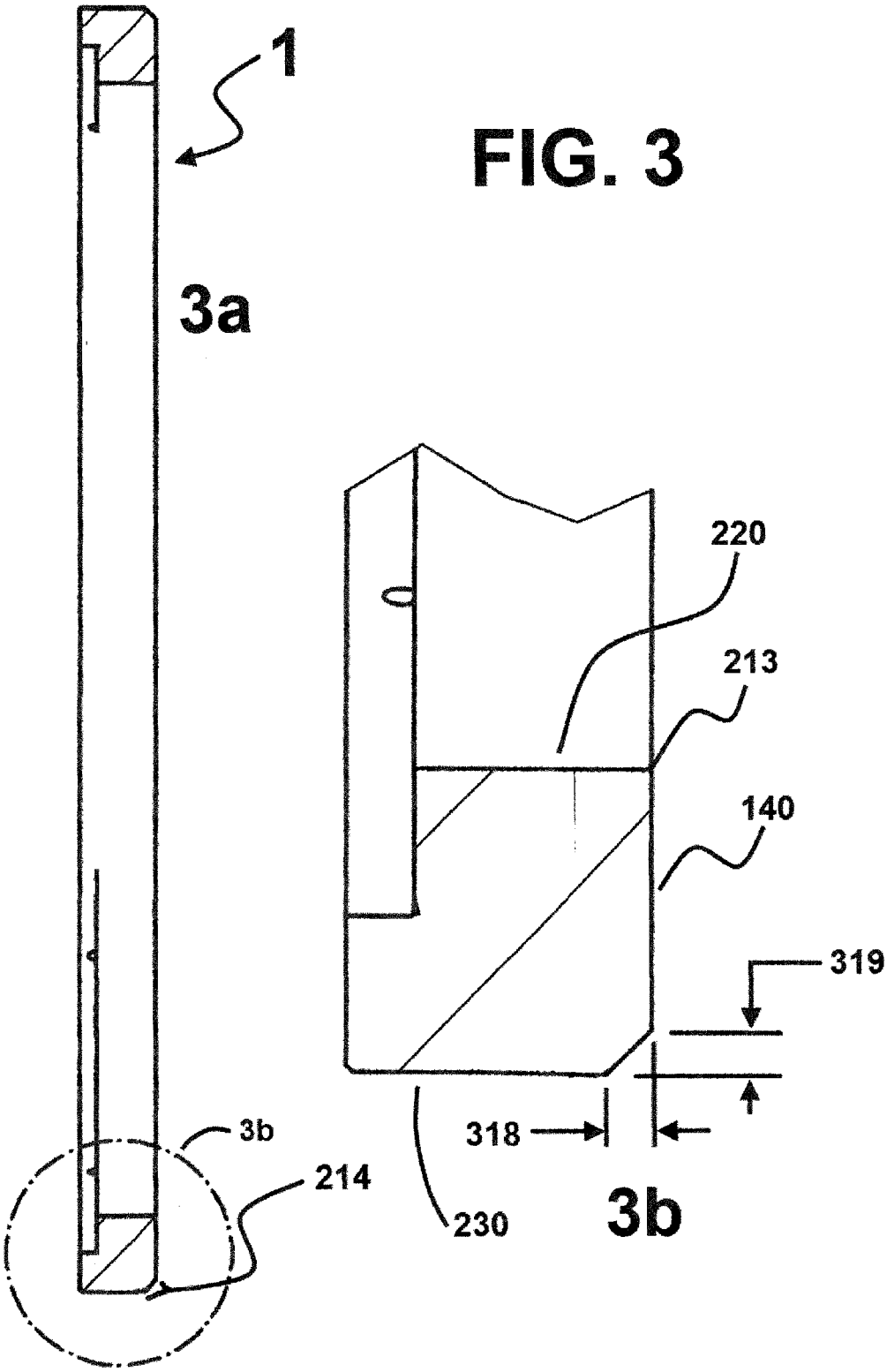
FIGS. 3*a* and 3*b* show a cross-section view of retainer ring 1 and an inset of that cross section respectively.

Upon simultaneous rotation of wafer assembly 130 and platen 122, the nap 126 of polishing pad 121 passes across front surface 140 of retainer ring 1, and thereafter across wafer 131, whereby wafer 131 is polished. During such operation, transition region 250 of retainer ring 1 defines the area over which, due to the application of pressure $P_r$ on nap 126, resilient asperities 126 tend to become distorted, with the result that regions of nap 126 are compressed beneath front surface 140, at least until passing from beneath wafer assembly 130. The 45° taper extending radially across transition region 250 and along the entire circumference of retainer ring 1 as shown in FIG. 3 results in a gradual application of pressure P during a period of time defined by taper length 319 and the rate of movement of surface asperities 126 of pad 121 relative to wafer assembly 130.

Transition region 250 therefore acts to reduce wear caused by retainer ring 1 by facilitating a less abrupt application of pressure $P_r$ to nap 126 as it passes beneath wafer assembly 130.

Figure 4:
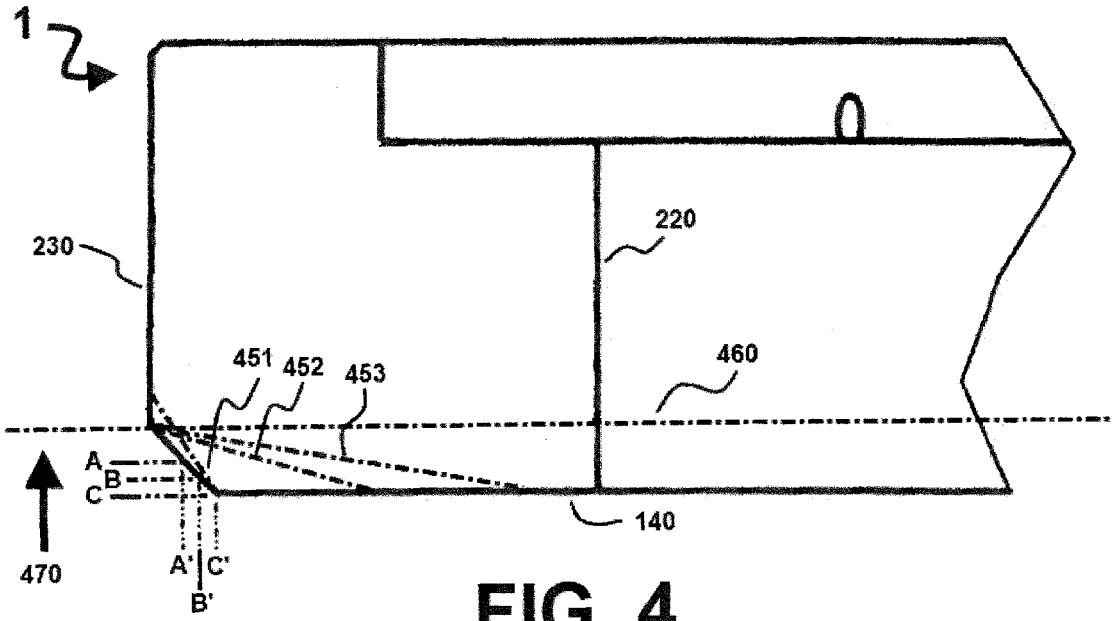
FIG. 4 shows an orthographic view of retainer ring 1.

The tapered transition region 250 has been described above as having a straight taper of 45°, resulting in a taper length of 2 mm. However, as shown in FIG. 4, the transition region may be characterized by a taper of different angles greater or less than 45° resulting in varying taper lengths. Moreover, taper length can be varied by other means, such as through variation of taper depth.

Depending on the expected interaction between the polishing pad, slurry and wafer, as well as other metrological considerations, retainer rings with one of a range of taper lengths may be employed to selectively match the retainer ring to a wide range of polishing specifications informing the CMP process. FIG. 4 is a general side profile of retainer ring 1 illustrating selected variations in straight taper profiles consistent with the disclosure. The precise profile, in terms of length, angle and shape are understood to be independently variable, and in no way limited to the examples 451, 452 and 453 shown. The examples are illustrative of the variability of at least the taper length of the transition region depending upon the profile characteristics selected. As noted above, retainer ring 1 has a service life typically defined by a maximum wear depth 460 beyond which the ring may no longer reliably retain the wafer being polished or may require replacement for other reasons. As the ring wears, the effective taper length 319 (FIG. 3) may be reduced, with the result that the transition region becomes smaller as wear progresses. To the extent that wear depth 460 may define a particular end-of-life for retainer ring 1, and therefore a point of maximum wear, taper depth 318 (FIG. 3) may advantageously be set at a point beyond the expected maximum wear depth, in order to ensure that at least a minimum effective transition region is present near end-of-life of retainer ring 1. Likewise, to the extent that ring wear may progressively act to reduce the effective taper depth of retainer ring 1, the surface area of front face 140 may be expected to progressively increase. Any resulting changes in pressure $P_r$, as shown in FIG. 1, may therefore be compensated if necessary, for example, by adjusting force F. Alternatively, the ring may have a pressure system independent of the pressure on the wafer, in which case the pressure system would be adjusted independently. Ring 1 is shown having levels, A, B, C, which represent arbitrarily selected ring depths throughout the life of the ring. Wear direction of ring 1 is shown by arrow 470. Front surface 140, when ring 1 is new, is at level C. After a certain period of use, the front surface 140 of ring 1 would then wear down to level B and then progressively to level A. FIG. 4 also illustrates other possible tapered transition regions, 451, 452, 453 that could be provided on ring 1, each providing a profile having characteristics that may be more or less suitable depending on the polishing application.

As shown in FIG. 4, as ring 1 begins to wear, the amount of surface area contacting polishing pad 221 by front surface 140 is increased as the transition region becomes narrower. A tapered transition region having a taper such as shown with 451 extending beyond the ring's expected service life 460 (i.e. the taper starts further into the ring than the service life line 460) reduces the surface area of ring 1 available throughout the ring's life and especially at the end of the ring's life. Accordingly, ring 1 may be advantageously designed to reach the end of its service life with at least some measurable transition region remaining. Alternatively, depending, for example, on the wear-sensitivity of polishing pad 121, or on the particular parameters of the polishing cycle, the presence of a taper sufficient to provide a transition region may not be required, for example, when pad replacement is undertaken whenever a new ring is installed.

The angle of the taper can be chosen to maximize the surface area to transition ratio for conditions selected in accordance to certain wear properties. A softer polishing pad, more susceptible to wear, may be advantageously paired with a ring having a different taper angle than might be appropriate for a harder pad. However, as the ring wears from point B to point A, the taper length and thus the distance over which transition takes place decreases as well from B' to A'. Likewise, ring 1 has progressively more surface area in contact with pad 221. Accordingly, a wide variety of polishing requirements and conditions are advantageously considered in selecting a taper profile that minimizes production overhead during CMP. Optionally, it may be advantageous to pair retainer rings having particular taper profiles with polishing pads to which they are most suited.

Figure 5:
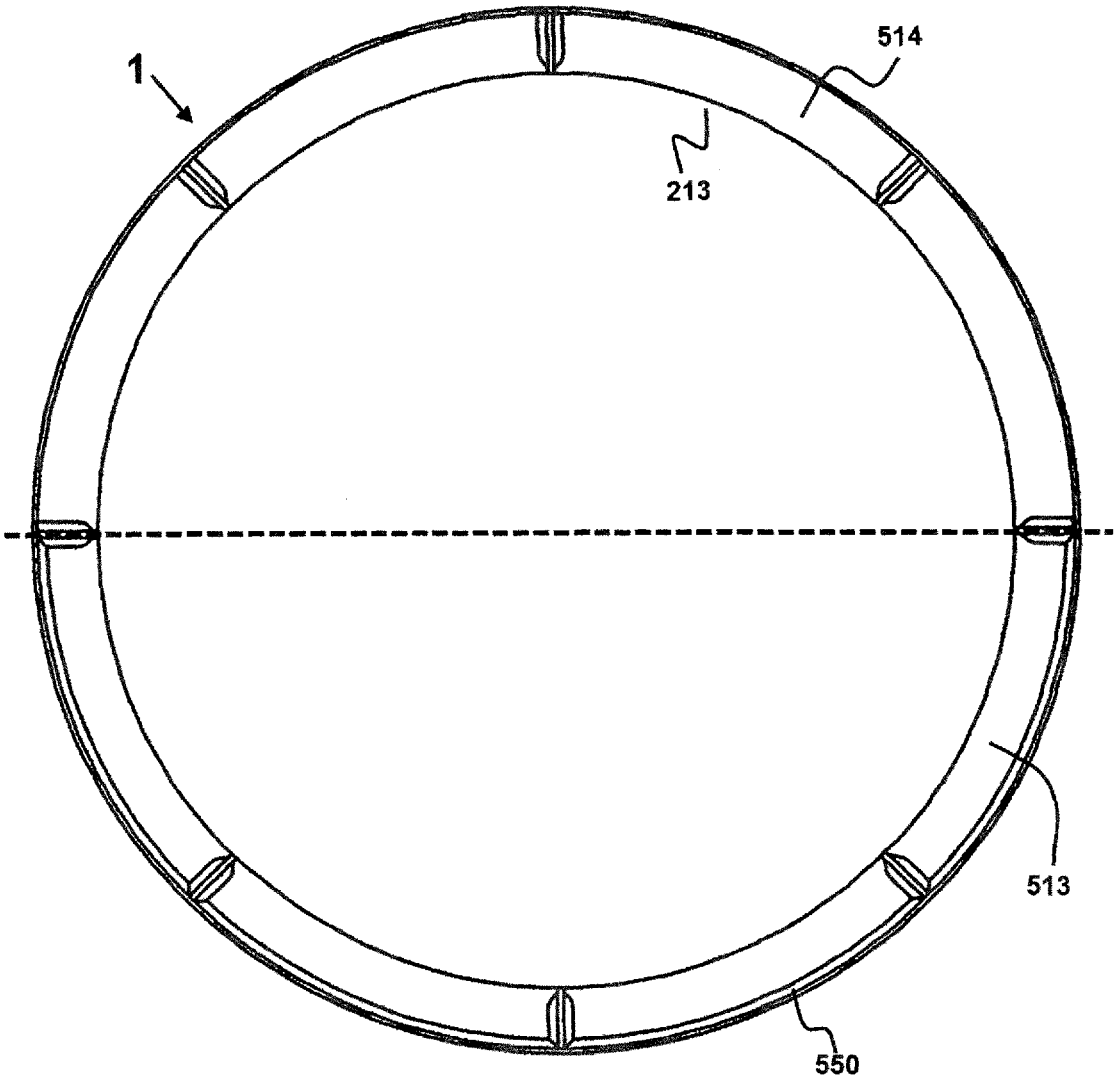
FIG. 5 shows the wear patterns associated with a retainer ring 1.

FIG. 5 discloses another aspect of this disclosure. Retainer ring 1 is not limited to a taper on the entirety of the perimeter of ring 1. The taper can be optimized to the polishing process in which the retainer ring is used. For instance, where the CMP process takes place with a retainer ring 1 is configured to be fixed relative to the direction of rotation of platen 122, the ring may be apportioned into a lead half 513 and a lag half 514. Lead half 513 is provided with a taper on its transition region 550 which stops at the border of the lag half During operation, ring 1 remains effectively stationary relative to the movement of platen 122, with the result that transition to the compressed state of polishing pad 121 only occurs on the lead half.

The conical profile formed by the linear taper of transition region 250 shown in FIG. 2 is also not limiting. In another aspect of this disclosure, the tapered transition region 250 is not conical as described above but can be formed into a convex or concave shape. Transition region 250 can also include a textured transition along the linear, convex or concave profile. Some examples of textured transitions could be dimpling, scaling or peening of all or part of the transition region. Multiple flat surface profiles may be added along the circumference of retainer ring 1, with the result that the transition region has a profile that varies along its dimension.

Specifically, transition region 250 may comprise, for example, each of a concave, convex, textured or conical profile at various points along the circumference. In particular, variations in texture may be overlaid over any profile, or variations thereof, in a single retainer ring without departing from the scope of this disclosure. Moreover, the textured surface may extend beyond transition region 250, and into front surface 140, resulting in texturing of at least a part of front surface 140.

Referring again to FIG. 2*a*, front surface 140 of retainer ring 1 is shown further including eight straight radial channels 212 inscribed in the front surface 140, each channel disposed along radial projections from a center of retainer ring 1, and spaced for example at 45° from an adjacent channel. FIG. 6 with inset FIG. 6*b* is a cross-section view from the inside of ring 1 showing more details of channels 212. FIG. 7 with inset 7*b* is an orthographic side view of the ring 1 shown from the outside. Channels 212 extend the width of the front surface 140 from inner surface 220 to outer surface 230. Channels 212 are shown configured with 45° channel tapers 222, extending partially from the outer surface 230 along the inside of channels 212 to a distance for example 4.5 mm from inner surface 220. At this point, the taper gradually diminishes for example until 1 mm from inner surface 220. FIG. 7 shows tapered transition region 250 found between front 140 and outer surfaces 230 and channel tapers 222 located in channel 212 are shown joined at mitered edge 740. Channel taper 222 may also be independently or concurrently configured to match the taper of transition region 250 (i.e. any of a conical, convex, concave or textured profile, or any combination thereof can be applied to channel taper 222 of channels 212. As shown, the profile of channel taper 222 matches that of characterizing transition region 250, in particular a 45° angle. However, the channel tapers advantageously take on any angle and do not depend upon the profile of transition region 250. Provided channels 212 are present, any channel tapers 222 may be absent from one or more of channels 212. Moreover, channel tapers may occupy only a fraction of channel 212.

In operation, channels 212 provide for transport of slurry. However, to the extent that the edges of channels 212 are exposed to moving polishing pad 121, particularly as wafer assembly 130 is rotated, potential wear overhead can be minimized by the prolonged transition provided by channel tapers 222, in a manner similar to the effect produced by transition region 250, described above. More particularly, to the extent that rotation of retainer ring 1 takes place in one direction due to rotation of wafer assembly 130, the transition effects of the edges 261/262 of channel 212 are asymmetrical in some respects. For example, during clockwise rotation, edge 261 would be a falling edge (defined as the edge opposite the leading edge), wherein compressed asperities of polishing pad 121 transition to an uncompressed state, thereafter to be compressed again by leading edge 262. As the wear dynamics at falling edge 261 differs to that of leading edge 262, consideration for channel tapers 222 on each of the respective edges may also be different. As shown, the falling edge may essentially be a 90° sharp edge, whereas the leading edge is provided with a 45° taper to prolong the time during which pad asperities 124 transition from an uncompressed to a compressed state, thereby reducing wear due to the transition, thereby leading to an overall reduction in wear overhead during CMP. In general it may be assumed that the release of asperities from compression is a self-regulated process unaffected by the transition region at a falling edge. However, to the extent that the profile of a falling edge may contribute to production overhead, appropriate tapers may be provided as well on falling edges.

In FIG. 8, the leading edge 816 of channel 812 (defined as the edge moving in the direction of rotation) is tapered as described above with a 45 degree angle. However, a taper has not been applied to falling edge 817 (defined as the edge opposite the leading edge). To the extent that tapering slows the rate at which the pad is compressed by interaction with slurry, tapering only leading edge 816 of channel 812 would have a greater effect than tapering falling edge 817. As a result, the surface area of the retainer ring 1 in contact with the polishing pad 221 is increased, allowing other areas of ring 1 to be adjusted with less surface area. The taper on channels 812 does not have to match the tapered transition region 250. In fact, surface area can be maximized by allowing the two tapers to be independently configured and/or optimized.

Figure 9:
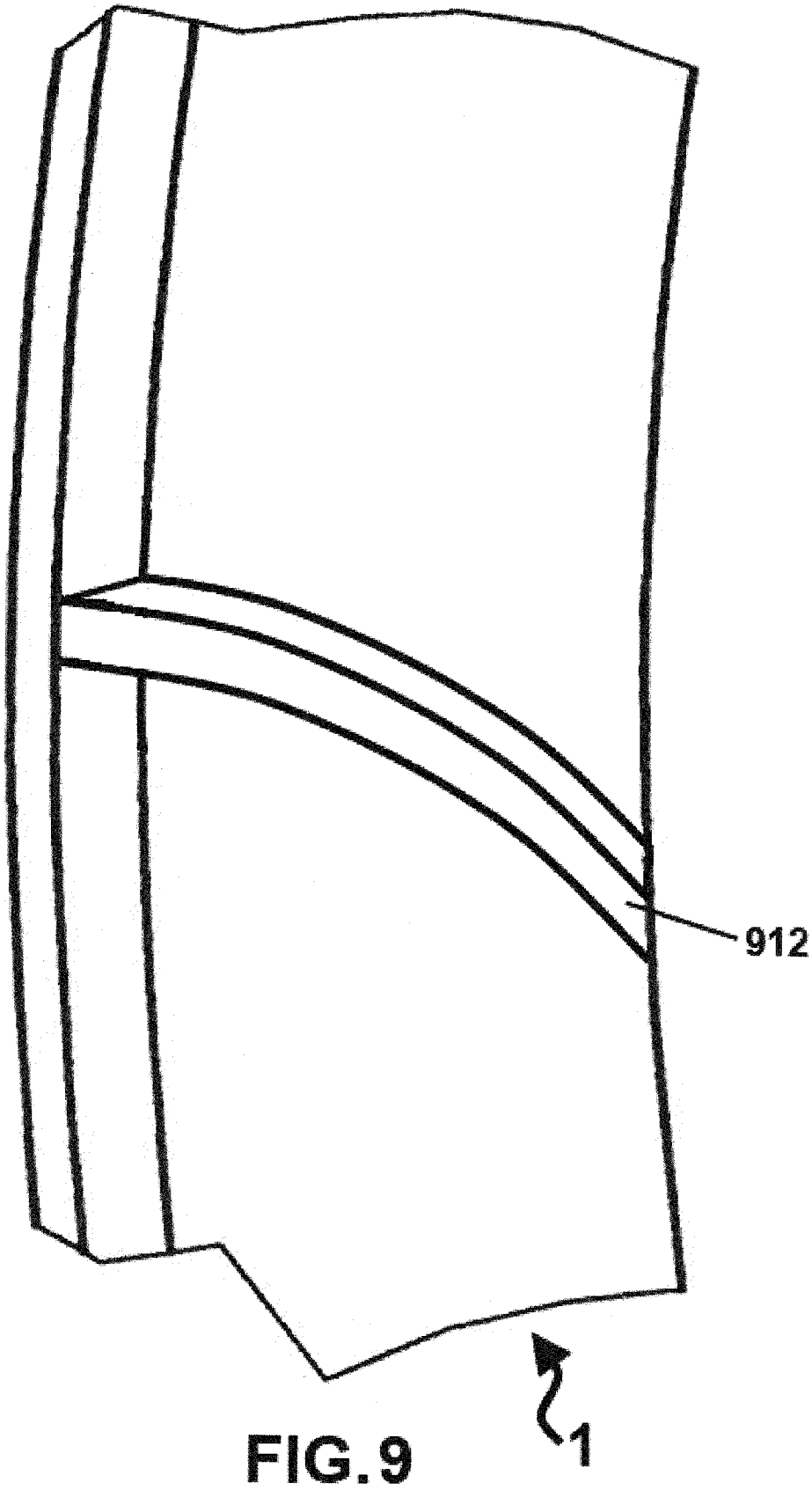
FIG. 9 shows an orthographic view of an aspect of retainer ring 1.
Figure 10:
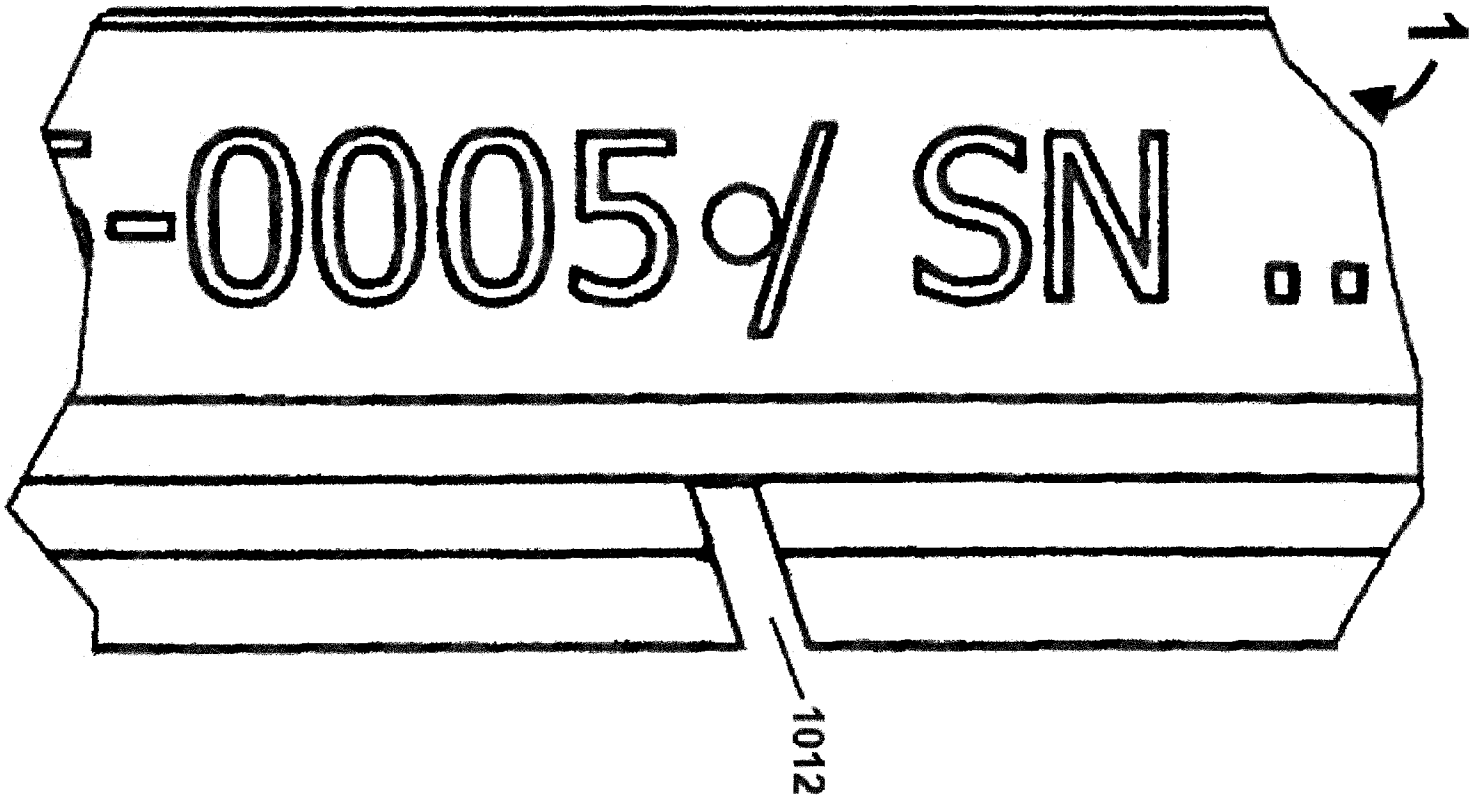
FIG. 10 shows an orthographic view of an aspect of retainer ring 1.

FIGS. 9 and 10 further illustrate alternative channel formations. FIG. 9 is a top view of retainer ring 1 having a machined accurate channel 912. Similarly to channel 812 described in FIG. 8 above, only the leading edge of the channel 912 has been tapered. FIG. 10 illustrates an inclined channel 1012. In this example, a taper on the channel wall is unnecessary as the groove has been inclined so that the leading edge inherently provides an angled approach, such as at a 45° angle. To the extent that no transition region is required on a falling edge, it may be sufficient to provide the angled channel without formation of a transition region on either side, the angled approach providing adequate transition on one edge, advantageously designated the leading edge depending upon rotation direction of retainer ring 1. However, additional tapering/texturing may provide additional advantages on either the leading or falling edge. Neither of the above shapes is limiting. Channel 212 can be formed in a variety of shapes that promote particular CMP requirements and/or slurry movement, alone or in combination with the embodiments disclosed above. For example, shaped channel 812 may include a convex, concave or textured transition region. Likewise, multiple channel types can be combined, such as a straight, angled or shaped channel, for example on a single retainer ring. It is also envisioned that channels 212 can be helical or formed in starburst patterns. Channels 212 also do not have to extend the length of front surface 140.

The invention claimed is:

1. A retainer ring for use in conjunction with a Chemical Mechanical Polishing apparatus for polishing a substrate, the retainer ring comprising:

an inner surface defining a retainer area;

an outer surface;

a front surface extending between the inner and outer surface, the front surface being in contact with a polishing pad during polishing;

a transition region between said outer surface and said front surface;

wherein the front surface includes at least one channel extending from the inner surface to the outer surface, wherein at least one wall of the channel includes a second transition region at least partially along the length of the channel; and wherein within the second transition region an angle between the front surface and the at least one wall of the channel is less than 90 degrees.

2. The retainer ring of claim 1, wherein the inner surface defining the retainer area is cylindrical.

3. The retainer ring of claim 2, wherein the transition region has a conical profile.

4. The retainer ring of claim 2, wherein the transition region is maximized to reduce wear on a polishing pad used to polish the substrate.

5. The retainer ring of claim 2, wherein the second transition region along a length of at least one channel forms a mitered edge with the transition region.

6. The retainer ring of claim 2, wherein the transition region is characterized by a taper depth selected to exceed the expected service depth of the ring.

7. The retainer ring of claim 2, wherein the transition region is characterized by a taper depth selected to not exceed the expected service depth of the ring.

8. The retainer ring of claim 1, wherein the transition region has a taper of 45 degrees.

9. The retainer ring of claim 1, wherein the transition region is concave.

10. The retainer ring of claim 1, wherein the transition region is convex.

11. The retainer ring of claim 1, wherein a lagging edge opposite a leading edge of the ring does not have a tapered transition region.

12. The retainer ring of claim 1, wherein the channel further comprises a region adjacent to the second transition region, the region being between the second transition region and the inner surface, and wherein within the region an angle between the front surface and the at least one wall of the channel is substantially 90 degrees.

13. An apparatus for use in Chemical Mechanical Polishing comprising: a polishing pad used to smooth a surface of a wafer; a retainer ring fixed in relation to movement of the polishing pad; the retainer ring having: an inner surface defining a retainer area; an outer surface; a front surface extending between the inner and outer surface, the front surface being in a transition region between said outer surface and said front surface; wherein the front surface includes at least one channel extending from the inner surface to the outer surface, wherein at least one wall of the channel includes a second transition region at least partially along its a length of the channel; and wherein within the second transition region an angle between the front surface and the at least one wall of the channel is less than 90 degrees.

14. The apparatus of claim 13, wherein the inner surface defining a retainer area is cylindrical.

15. The apparatus of claim 14, wherein the wafer is fixed with respect to the polishing pad.

16. The apparatus of claim 14, wherein the transition region has a conical profile.

17. The apparatus of claim 16, wherein the transition region has a taper of 45 degrees.

18. The apparatus of claim 14, wherein the transition region is maximized to reduce wear on a polishing pad used to polish the wafer.

19. The apparatus of claim 14, wherein the second transition region forms a mitered edge with a taper of the transition region.

20. The retainer of claim 13, wherein the transition region is concave.

21. The apparatus of claim 13, wherein the transition region is convex.

22. The apparatus of claim 13, wherein the transition region is characterized by a taper depth selected to exceed the expected service depth of the ring.

23. The apparatus of claim 13, wherein the channel further comprises a region adjacent to the second transition region, the region being between the second transition region and the inner surface, and wherein within the region an angle between the front surface and the at least one wall of the channel is substantially 90 degrees.

24. A method for polishing a wafer comprising: inserting a wafer into a retainer ring, rotating the wafer and the retainer ring, wherein the ring comprises an inner surface defining a retainer area;

an outer surface;

a front surface extending between the inner and outer surface, the front surface being in contact with a polishing pad during polishing;

a transition region between said outer surface and said front surface;

wherein the front surface includes at least one channel extending from the inner surface to the outer surface, wherein at least one wall of the channel includes a second transition region at least partially along the length of the channel; and wherein within the second transition region an angle between the front surface and the at least one wall of the channel is less than 90 degrees.

25. The method of claim 24, wherein the channel further comprises a region adjacent to the tapered region, the region being between the second transition region and the inner surface, and wherein within the region an angle between the front surface and the at least one wall of the channel is substantially 90 degrees.

* * * * *